US006118358A

United States Patent [19]

Crouch

[11] Patent Number: 6,118,358

[45] Date of Patent: Sep. 12, 2000

[54] HIGH AVERAGE-POWER MICROWAVE WINDOW WITH HIGH THERMAL CONDUCTIVITY DIELECTRIC STRIPS

[76] Inventor: David D. Crouch, 1278 Biltmore Cir., Corona, Calif. 91720

[21] Appl. No.: 09/233,725

[22] Filed: Jan. 18, 1999

[51] Int. Cl.[7] ..... H01P 1/08

[52] U.S. Cl. ..... 333/252; 333/239

[58] Field of Search ..... 333/239, 248, 333/252

[56] References Cited

U.S. PATENT DOCUMENTS

| | | | |
|---|---|---|---|
| 2,990,526 | 6/1961 | Shelton, Jr. | 333/252 |
| 3,156,882 | 11/1964 | Bondley | 333/252 |
| 3,275,957 | 9/1966 | Pickering et al. | 333/252 |
| 4,180,605 | 12/1979 | Gilbert et al. | 428/76 |
| 4,286,240 | 8/1981 | Shively et al. | 333/252 |
| 4,458,223 | 7/1984 | Schmidt | 333/252 |
| 4,536,442 | 8/1985 | Bovenkerk et al. | 428/323 |
| 4,930,442 | 6/1990 | Iida et al. | 118/723 |
| 4,965,541 | 10/1990 | Okazaki | 333/252 |
| 5,051,715 | 9/1991 | Agosti et al. | 333/252 |
| 5,132,652 | 7/1992 | Doehler et al. | 333/252 |
| 5,173,443 | 12/1992 | Biricik et al. | 437/181 |
| 5,243,311 | 9/1993 | Jones | 333/252 |
| 5,400,004 | 3/1995 | Moeller | 333/252 |
| 5,548,257 | 8/1996 | Caplan et al. | 333/252 |
| 5,568,015 | 10/1996 | Holber et al. | 315/39 |
| 5,625,259 | 4/1997 | Holber et al. | 315/111.21 |
| 5,627,542 | 5/1997 | Paquette | 264/122 |

*Primary Examiner*—Justin P. Bettendorf
*Attorney, Agent, or Firm*—David W. Collins; Andrew J. Rudd; Glenn H. Lenzen, Jr.

[57] ABSTRACT

A high average-power microwave window is provided whose thermal conductivity has been enhanced to enable it to transmit higher average RF power levels than conventional windows of the same size. Such a window is suitable for use with high-average power RF sources such as klystrons and magnetrons. The window comprises a ceramic substrate, typically a low-loss ceramic such as alumina or quartz, to which narrow strips of a high thermal conductivity material have been bonded. One such high thermal conductivity material is synthetic polycrystalline diamond, which can be bonded to the surface of a dielectric substrate using a high-temperature cement or can be directly deposited on the surface by a process such as chemical vapor deposition (CVD). High-purity alumina, a commonly-used material for high-power RF windows, has a thermal conductivity of 26.4 W/m·° C., while synthetic diamond has a thermal conductivity of 1000 W/m·° C., 2.6 times that of copper and 38 times that of alumina. The novel feature is the use of high thermal conductivity strips to increase the effective thermal conductivity of a microwave window by providing low-resistance paths by which heat can be extracted from the window, resulting in a significant increase in the window's power-handling capacity.

16 Claims, 4 Drawing Sheets

HIGH AVERAGE-POWER MICROWAVE WINDOW WITH HIGH THERMAL CONDUCTIVITY DIELECTRIC STRIPS

This invention was made with United States Government support under Contract No. F2960192-C-0124 awarded by the Department of the Air Force. The U.S. Government has certain rights in this invention.

TECHNICAL FIELD

The present invention is directed to ceramic windows for use in transmitting microwave radiation, and, in particular, to microwave windows having enhanced thermal conductivity.

BACKGROUND ART

The prior art in high-average power microwave window technology is the ceramic output window. Such windows are typically constructed from low loss ceramic materials such as alumina ($Al_2O_3$) or beryllia (BeO). The disadvantage of alumina is its low thermal conductivity, which limits its power handling capacity. While BeO has a much higher thermal conductivity than alumina (196 W/m·° C. at 100° C.), it is highly toxic in powder form and its use is being discontinued by the microwave tube industry. Windows of all-diamond construction are just now coming into use in high frequency tubes (X- and Ku-band TWTs and millimeter-wave gyrotrons, for example); for such frequencies, however, the windows are relatively small and the cost of the window is a small fraction of that of a high-dollar value microwave tube whose cost can easily exceed $200 K. At frequencies closer to 1 GHz, the size of the window makes the cost of an all-diamond window prohibitive.

Prior art approaches typically involve cooling fins. For example, U.S. Pat. No. 5,051,715, issued to G. Agosti et al, discloses a coupling-out window for linearly polarized microwaves. The coupling-out window comprises, for example, three cooling fins, a plate, which is transparent to microwaves, with strip-like portions as well as an annular mounting. The cooling fins are situated together with the plate in a common plate plane and are, according to a preferred embodiment, of the same thickness as the plate, so that the two plane main surfaces of the plate are formed. The cooling fins are aligned perpendicular to a direction of polarization of the microwaves and are in heat-conducting and pressure-locking contact with the plate.

U.S. Pat. No. 4,458,223, issued to W. Schmidt, discloses a microwave window assembly having cooling means. The microwave window assembly has a ceramic window, such as alumina or beryllia, with a thickness of more than 10 mm, corresponding to a half wavelength of the microwave energy. The window has a metallized side surface, e.g., copper, and is connected by means of a soldered joint to a frame.

U.S. Pat. No. 5,627,642, issued to D. G. Paquette, discloses a method of making a radar transparent window material operable above 2,000° C. and possessing high tensile strength. The method comprises blending a powder mixture of 20 to 60 wt % silicon nitride, 12 to 40 wt % boron nitride, 15 to 40 wt % silica, and 1 to 20 wt % oxygen-carrying sintering aids. The mixture is molded to shape as a preform and is densified by the simultaneous application of pressure and heat to form a monolithic window. The resulting radar transparent window is characterized by a monolithic microstructure consisting of $Si_2ON_2$, suspended BN particles, silicon nitrides, various oxynitrides, and silicate materials associated with the oxide sintering aids and minimal unreacted silicon.

U.S. Pat. No. 5,400,004, issued to C. P. Moeller, discloses a distributed window for large diameter waveguides. The window comprises a stack of alternating dielectric and hollow metal strips, brazed together to form a vacuum barrier. The strips are oriented to be perpendicular to the transverse electric field of the incident microwave power. A suitable coolant flows through the metallic strips. The metallic strips are tapered on both sides of the vacuum barrier, which taper serves to funnel the incident microwave power through the dielectric strips.

U.S. Pat. No. 4,536,442, issued to H. P. Bovenkerk et al., discloses a process for making diamond and cubic boron nitride compacts for optical windows. In making the single layer diamond windows, utilization of relatively large diamonds is preferred. The single layer will result in straight-through light paths and the catalyst/binder phase in the matrix would not interfere with transmittance. The compact windows are made by exposing a sample of diamond, for example, in a diamond and graphite matrix, to high pressure-high temperature conditions.

The foregoing references either require complex structures to remove heat from the microwave window or fail to address the problem of enhancing thermal conductivity of the window to enable it to transmit higher average RF power levels. Thus, what is needed is a high-power microwave window having an enhanced thermal conductivity while avoiding most, if not all, of the problems of the prior art.

DISCLOSURE OF INVENTION

In accordance with the present invention, a high average-power microwave window is provided whose thermal conductivity has been enhanced to enable it to transmit higher average RF power levels than conventional windows of the same size. Such a window is suitable for use with high-average power RF sources such as klystrons and magnetrons. The window comprises a ceramic substrate, typically a low-loss ceramic such as alumina or quartz, to which narrow strips of a high thermal conductivity material have been bonded. One such high thermal conductivity material is synthetic polycrystalline diamond, which can be bonded to the surface of a dielectric substrate using a high-temperature cement or can be directly deposited on the surface by a process such as chemical vapor deposition (CVD). High-purity alumina, a commonly-used material for high-power RF windows, has a thermal conductivity of 26.4 W/m·° C., while synthetic diamond has a thermal conductivity of 1000 W/m·° C., 2.6 times that of copper and 38 times that of alumina. The novel feature of this invention is its use of high thermal conductivity strips to increase the effective thermal conductivity of a microwave window by providing low-resistance paths by which heat can be extracted from the window, resulting in a significant increase in the window's power-handling capacity.

The purpose of the present invention is to increase the power-handling capacity of a high average-power microwave window. One advantage of this invention is that it can transmit more microwave power than conventional ceramic windows of the same size, which have shown a tendency towards catastrophic failure due to over-heating at high average power levels. Another advantage is that an enhanced-conductivity window like that described here is more economical than a window constructed from diamond alone, as the cost per unit area of diamond sheet scales with its thickness, and mechanical strength considerations impose a minimum thickness on the window. For example, a low-purity diamond gyrotron window having a diameter of 2.5" and a thickness of 35 mils can be obtained from Norton for approximately \$8 K, which corresponds to \$1630 per $in^2$. An all-diamond window of the same thickness suitable for use in WR-975 waveguide would have an area of 47.5 $in^2$ and would cost at least \$77.5 K. If the waveguide were to be evacuated on one side of the window, however, it might be necessary to increase the window thickness by a factor of two, which would bring the cost of the window to approximately \$155 K (assuming that the window cost scales linearly with thickness). Depending on the application and the power involved, it might be enough to construct a window from a single sheet of dielectric substrate with high-conductivity strips bonded to each surface. Such a window will clearly be far less expensive than a window of all-diamond construction, particularly at frequencies $\leqq 1$ GHz, where window sizes are significant.

BEST MODES FOR CARRYING OUT THE INVENTION

The invention described herein is a microwave window whose enhanced thermal conductivity enables it to transmit higher average power levels than a comparably-sized conventional microwave window. The thermal conductivity of the window is increased by bonding narrow strips of a high thermal conductivity material to the surface, thereby providing parallel paths by which heat can be removed from the window. As defined herein, the term "high average power" means that if one arbitrarily defines high average power P as being P>100 kW at a frequency of 1 GHz, then, for propagation in a waveguide, a measure of high average power is whether or not $P/\lambda^2 \geqq 111$ (since 100,000 $W/\lambda^2=111$ at a frequency of 1 GHz, where the wavelength $\lambda=30$ cm).

Conventional RF windows are typically constructed from low-loss ceramics such as alumina and beryllia. As used herein, the term "loss-loss ceramic" refers to a ceramic material having a loss factor<0.005.

Alumina is a poor thermal conductor, having a thermal conductivity of 26.4 W/m·° C. at 100° C. While beryllia is a much better thermal conductor, having a thermal conductivity of 196 W/m·° C. at 100° C., it is highly toxic in dust form and is being discontinued by the microwave tube industry. An alternative approach is to bond narrow strips of a high-conductivity material to a lower-conductivity ceramic substrate. This approach provides low-thermal resistance parallel paths by which heat can be removed from the window, as illustrated in FIG. 1.

Figure 1:
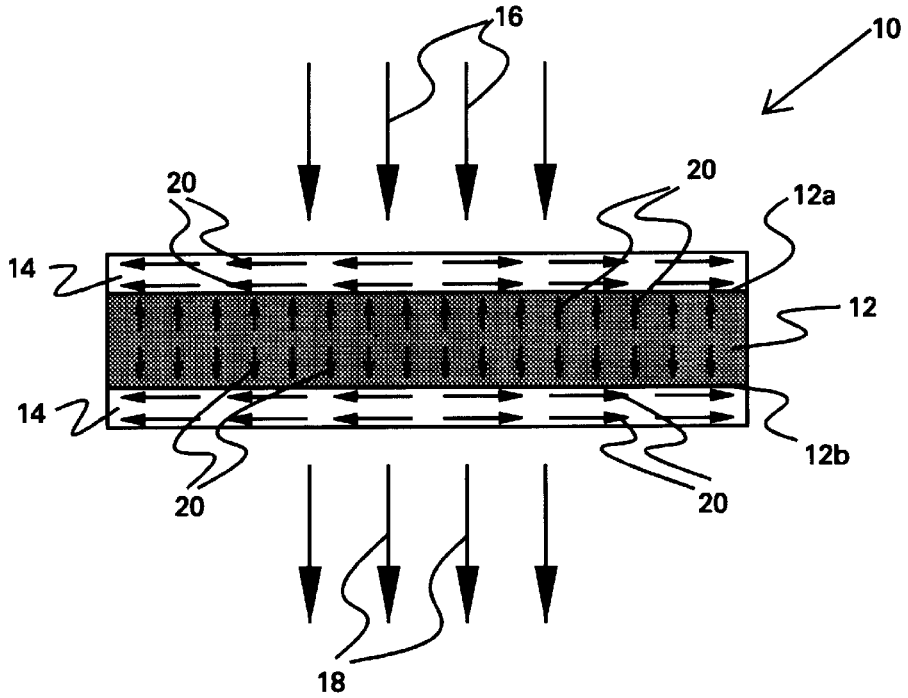
FIG. 1 is a schematic diagram, in cross-section, depicting heat flow in a dielectric window constructed from a low-conductivity substrate to which a number of high-conductivity strips have been bonded, in accordance with the present invention.

As shown in FIG. 1, a dielectric window 10 comprises a dielectric substrate 12, having a thickness $d_{substrate}$, is sandwiched between two high thermal conductivity strips 14, each having a thickness $d_{strip}$. RF power IN is shown by arrows 16, while RF power OUT is shown by arrows 18. The heat flow is indicated by arrows and is normal to the RF power IN. As used herein, the term "high thermal conductivity" means that the conductivity of the strips 14 is much greater than that of the substrate 12 , $K_{strip} >> K_{substrate}$.

Heat flows from the substrate 12 both perpendicular and parallel to the RF power IN. FIG. 1 depicts the heat flow in the case in which a large enhancement to the thermal conductivity of the substrate 12 is achieved by sandwiching the substrate between the two high-conductivity layers 14, so that most of the radial heat flow is through the high-conductivity layers. By radial is meant perpendicular to the RF power IN. There will always be some radial heat flow in the substrate 12, of course. The purpose of the high-conductivity layers 14 is to minimize that radial heat flow in the substrate 12; indeed, it is desired that the heat travel the short distance to the high conductivity layers 14, where it can more quickly flow out of the window 10.

One such high-conductivity material is synthetic diamond, which in polycrystalline form has a thermal conductivity of 1000 W/m−° C. at 100° C. Diamond strips can be attached to a ceramic substrate in several ways. For example, diamond can be deposited in thin layers (up to about 20 $\mu$m in thickness with the current state of the art) on a ceramic substrate via chemical vapor deposition. Thicker free-standing layers (up to 2 to 3 millimeters in thickness) are currently available and can be bonded to a ceramic substrate using high-temperature, non-organic cements.

Figure 2:
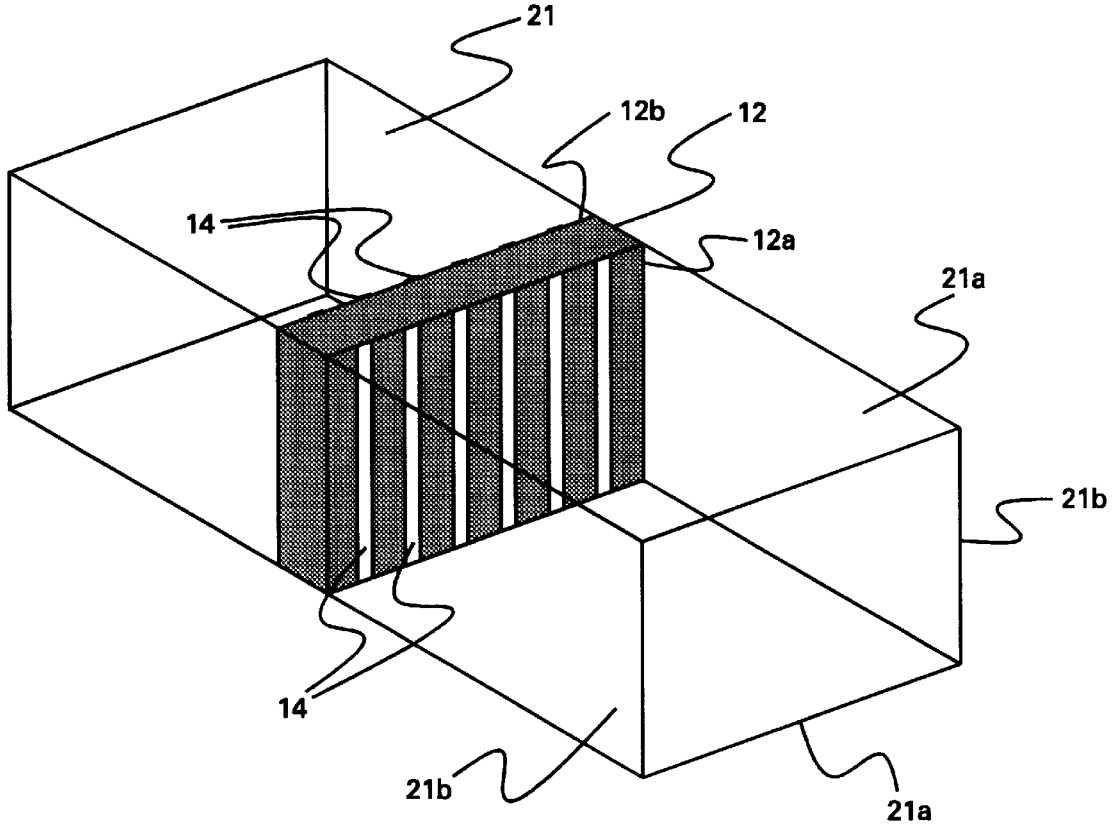
FIG. 2 is a perspective representation of a high average-power, enhanced-conductivity microwave window suitable for use in a rectangular waveguide, in accordance with an embodiment of the present invention.

A high average-power enhanced-conductivity microwave window 10 suitable for use in a rectangular waveguide 21 is shown in FIG. 2. The waveguide 21 may be rectilinear, in the sense that it can be rectangular, as shown, or square. The window comprise the dielectric substrate 12 with narrow strips 14 of high thermal conductivity material bonded to each face of the window. In this example, the strips 14 cover approximately 10% of each face 12*a*, 12*b* and provide low-resistance paths by which heat can be extracted from the window through the broad walls 21*a*, 21*b* of the waveguide 21. As used herein, the term "narrow" as applied to the high-conductivity strips 14 means having a minimum width subject to mechanical strength constraints, i.e., strips must be wide enough (and thick enough) that they will not break during window fabrication.

The extent of coverage of the substrate 12 by the strips 14 depends on the specific application and how much one is willing to pay for an enhanced-conductivity window. The upper limit is 100%; this, however, is a very expensive solution, as discussed below. There is no specific lower limit, since one will always obtain an enhancement to the thermal conductivity so long as f>0, where f is the fraction of window area covered. However, for small values of f, the enhancement will be small and may not be worth the effort. In light of the foregoing, a value of 10% coverage is a reasonable compromise that illustrates that one can substantially enhance the thermal conductivity of the window with a relatively small amount of high thermal conductivity material.

For a given value of f, one should use as many strips 14 as possible, in order to minimize the distance between neighboring strips. This implies that the strips be made as thin as possible, subject to mechanical constraints imposed by the fabrication process and the mechanical properties of the high-conductivity material.

If the strips 14 are bonded to the substrate 12, then the thickness needs to be such that this can be done without excessive risk of breakage. If deposited via CVD (chemical vapor deposition), there is no practical lower limit, except that very thin layers might be unevenly deposited due to variations inherent in the CVD process or might evidence undesirable pin-holes.

The preferred value of the thickness is the maximum commercially available, subject to any cost constraints on the total cost of the window 10. From a performance standpoint, thicker is better.

There is one additional constraint affecting the widths and thicknesses of the high-conductivity strips 14. For a given value of f, if the distance between neighboring strips is minimized (i.e., narrow strips are used), then the RF performance of the assembly of narrow strips will be little different from that of a uniform slab of high-conductivity material that completely covers the surface, and whose thickness is such that the volume occupied by the slab is the same as that of the plurality of strips covering one surface. The presence of the strips 14 will not excite evanescent higher-order modes in the waveguide, whose presence can make the design of an impedance-matching network for the window more difficult. If $d_{strip} \ll d_{substrate}$, where d represents the respective thickness, then the RF properties of the window will be little different from those of the bare substrate, assuming $d_{strip} \ll \lambda$ is also satisfied. On the other hand, if thick, widely-spaced strips 14 were to be used, it is likely that evanescent higher-order modes would be excited. In any case, such a design is undesirable thermally, since one wants to minimize the length of the low-conductivity thermal pathways, i.e., one wants to place the high-conductivity material as close to the heat sources as possible.

The effective thermal conductivity of a composite structure like that in FIG. 2 can be closely estimated by weighting the conductivities of the component layers:

$$k_{eff} = \frac{k_{substrate} + 2k_{strip} f (d_{strip} / d_{substrate})}{1 + 2f (d_{strip} / d_{substrate})} \quad 1$$

where $k_{substrate}$ and $k_{strip}$ are the thermal conductivities of the substrate 12 and high-conductivity strips 14, respectively, $d_{substrate}$ and $d_{strip}$ are their thickness, and f is the fraction of the window area that is covered by the high-conductivity strips.

As an example, consider a single 5 mm thick alumina substrate 12 having diamond strips 14 with $d_{strip}$=1 mm bonded to each face 12*a*, 12*b*. Using a thermal conductivity of 26.4 W/m−° C. for alumina and a conductivity of 1000 W/m−° C. for polycrystalline diamond, one obtains an effective thermal conductivity of $k_{eff}$=305 if f=1.0, which is more than 11 times that of the alumina substrate 12 alone. However, if only 10% of each surface 12*a*, 12*b* is covered by high-conductivity strips 14, then f=0.10 and $k_{eff}$=64. While the effective conductivity is less than one-fourth that obtained if each face 12*a*, 12*b* is completely covered with diamond, it is more than twice that of alumina alone and uses one-tenth the diamond required for complete coverage.

Reducing the coverage can significantly reduce the cost, as 1 mm thick wafers of polycrystalline CVD diamond currently cost approximately $2/mm$^2$ (source: Crystalline Materials Corporation, Phoenix, Ariz.). As an example, consider a window for use in a WR-975 waveguide 21, which has a width of 9.75 inch and a height of 4.875 inch. The window 10 will therefore have a surface area of 47.53 in$^2$, or 30,665 mm$^2$. Complete coverage of both surfaces would cost $123 K, while 10% coverage would cost just $12.3 K.

Figure 3:
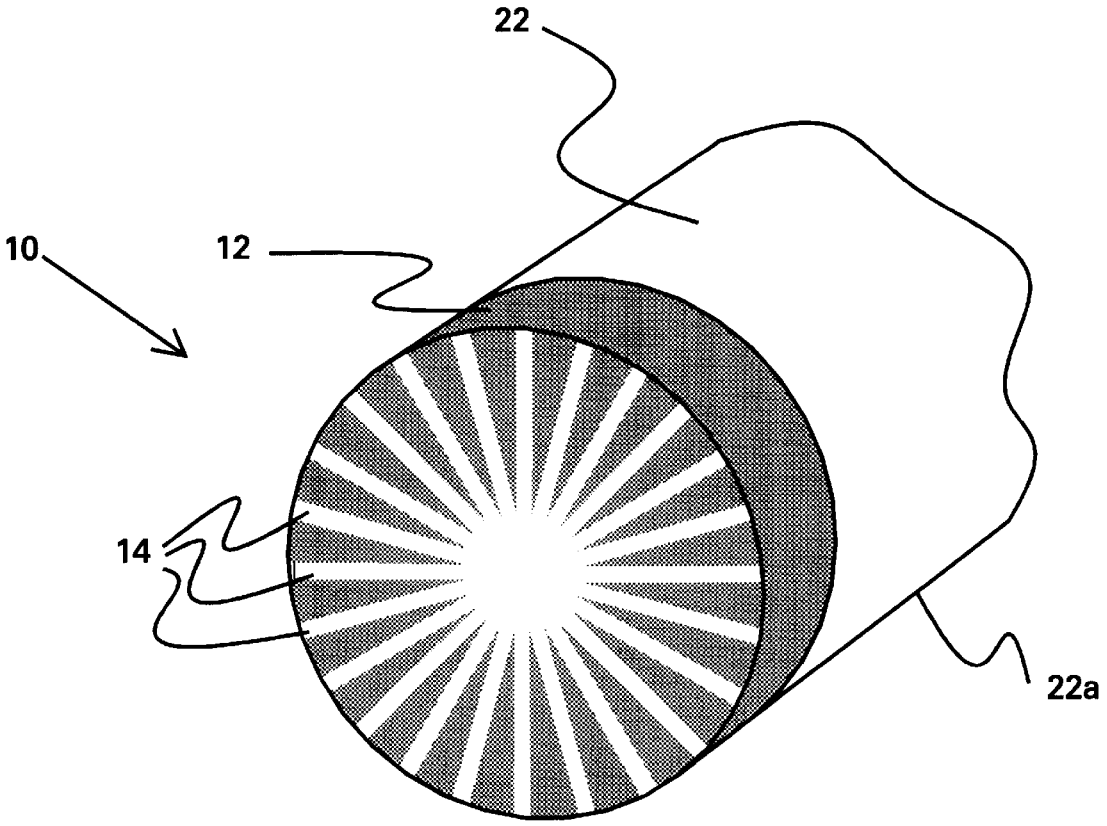
FIG. 3 is a perspective representation of a high average-power, enhanced-conductivity microwave window suitable for use in a circular waveguide, in accordance with another embodiment of the present invention.

High average-power windows 10 with enhanced thermal conductivity can also be constructed for use in a circular waveguide (22). FIG. 3 shows one possible implementation in which each high-conductivity strip 14 leads from a point near the center of the substrate 12 radially outward to the wall 22*a* of the waveguide 22. The radial configuration of the strips 14 minimizes the length of the path over which heat must travel to escape from the window 10. Ellipitical waveguides may also be beneficially employed in the practice of the present invention.

While alumina and beryllia have in the past been the most widely-used materials for RF windows, other materials should be considered as substrates to which high-conductivity materials can be bonded. A figure of merit used in evaluating candidate output window materials is given by $$\text{Figure of Merit} = \frac{\text{Thermal Conductivity}}{(\text{Loss Factor})(\text{Coeffecient of Thermal Expansion})} \quad 2$$

where the loss factor is the product of the material's dielectric constant and loss tangent. Data for a number of candidate substrate materials with and without polycrystalline diamond strips bonded to both surfaces are given in Table I below. In Table I, 10% coverage is assumed. The figure of merit is normalized to that of a bare alumina abstrate. In addition to a high thermal conductivity, one also desires a small loss factor and a low thermal expansion coefficient in a window substrate material. A low-loss material will absorb less microwave power and consequently will experience a smaller temperature rise. A window 10 constructed from a material having a low thermal expansion coefficient will expand less; the resulting internal stresses will be smaller, reducing the likelihood of mechanical failure. Based on this figure of merit, fused quartz emerges as the best candidate for a diamond-coated window substrate material 12. Its low thermal conductivity, which has heretofore discouraged its use as a window material, is mitigated by the high-conductivity diamond strips 14. More importantly, the extremely low thermal expansion coefficient of fused quartz is smaller even than that of polycrystalline diamond, which is $1.2\times10^{-6}$ m/m−° C. As a result, thermally-induced internal stresses will be smaller with fused quartz than with other materials. Moreover, its thermal expansion coefficient is better matched to that of polycrystalline diamond than any of the other candidate materials, so that diamond strips 14 will remain bonded to a fused quartz substrate 12 at elevated temperatures.

TABLE 1

Properties of candidate window substrate materials with and without 1 mm thick diamond strips bonded to each surface of a flat substrate having a thickness of 5 mm.

| Material | Dielectric Constant | Loss Factor | Thermal Conductivity (W/m · ° C.) bare | Thermal Conductivity (W/m · ° C.) with 10% layer | Coefficient of Thermal Expansion ($10^{-6}$ m/m · C.) | Normalized Figure of Merit (bare) | Normalized Figure of Merit (with layer) |
|---|---|---|---|---|---|---|---|
| Alumina | 9.6 | 0.0008 | 26 | 63.5 | 8.2 | 1 | 2.4 |
| BeO, 99.5% | 6.6 | 0.001 | 201 | 231.7 | 64 | 7.9 | 9.1 |
| Fused Quartz | 3.6 | 0.0014 | 0.84 | 39.3 | 0.55 | 0.28 | 13.1 |
| Sapphire | 11.53 (‖) | 0.0022 | 25 | 62.5 | 8.6 | 0.33 | 0.825 |
| | 9.35 (⊥) | 0.0045 | | | | 0.16 | 0.4 |
| Silicon Nitride | 8.1 | 0.00486 (at 35 GHz) | 35 | 72.1 | 3.5 | 0.52 | 1.07 |
| Aluminum Nitride | 8.6 at 1 MHz | 0.00172 | 80 | 115.4 | 4.3 | 2.7 | 3.9 |
| Polycrystalline Diamond | 5.7 at 1 MHz | 0.00342 | 1000 | n/a | 1.2 | 61.5 | n/a |

Without being limiting, the low-loss ceramic material of the substrate 12 may comprise an oxide, a nitride, a carbide, or a boride. Other potential substrate materials include alumina, beryllia, sapphire, silicon nitride, and aluminum nitride.

Figure 4:
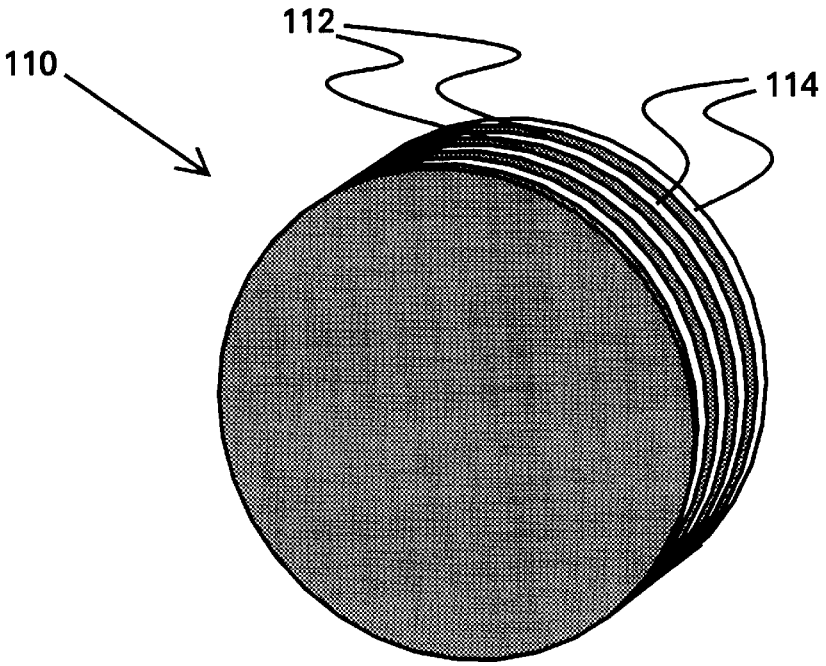
FIG. 4 is a perspective representation of a high average-power microwave window constructed by alternating layers of low-conductivity dielectric with thin layers of high-conductivity material, in accordance with yet another embodiment of the present invention.

Polycrystalline diamond is not the only material that can be used as strips 14 to increase the effective thermal conductivity of microwave windows 10. Another candidate material for high-conductivity strips 14 is cubic boron nitride, whose thermal conductivity is comparable to that of polycrystalline diamond and may eventually be more cost effective. Clearly, the cost of the high-conductivity material 14 can be a significant fraction of the cost of the entire window 10. If less expensive alternatives to diamond can be found, the cost of the window 10 can be reduced and a larger fraction of the window's surface area can be covered with strips 14 of high-conductivity material, enabling the window to transmit even higher average power levels. The availability of lower-cost alternatives to diamond will allow the effective thermal conductivity to be increased even further. For example, the dielectric substrate 12 can be divided into a number of layers 112 and high-conductivity layers 114 bonded between neighboring layers to form a window 110, as shown in FIG. 4. Such a design places the high-conductivity material 114 in closer proximity to the points at which the heat is absorbed, reducing the average distance that the heat must travel through the low-conductivity dielectric substrate 112 to reach a high-conductivity layer and resulting in a lower window temperature for a given amount of transmitted microwave power.

Figure 5A:
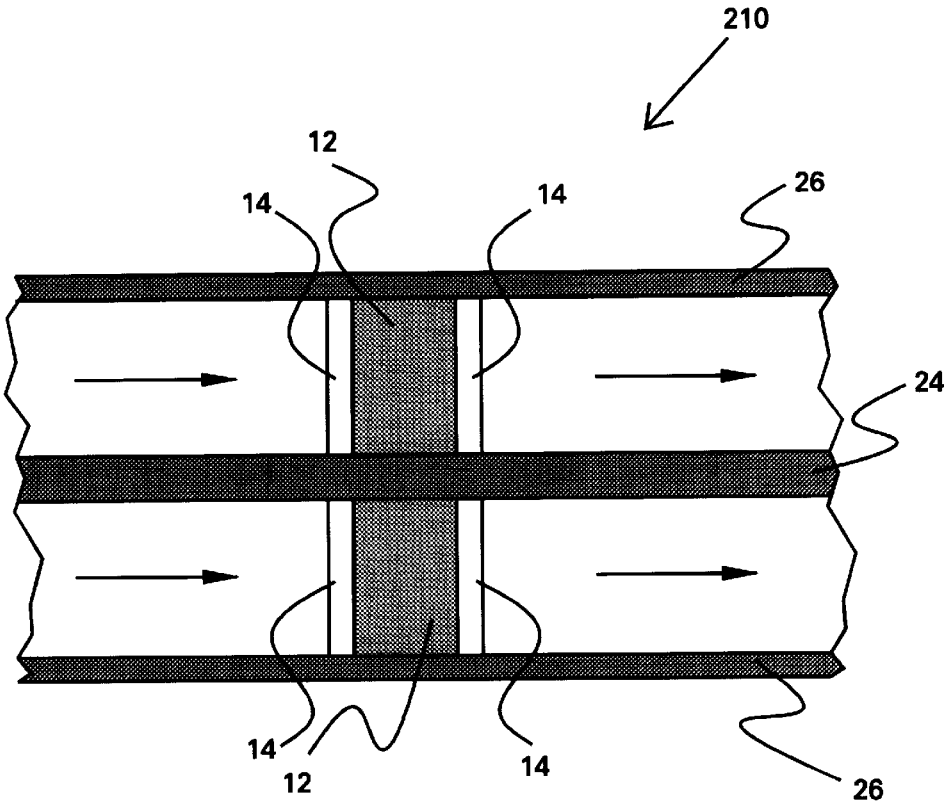
FIG. 5*a* is a cross-sectional view of a high average-power microwave window constructed in a coaxial transmission line.
Figure 5B:
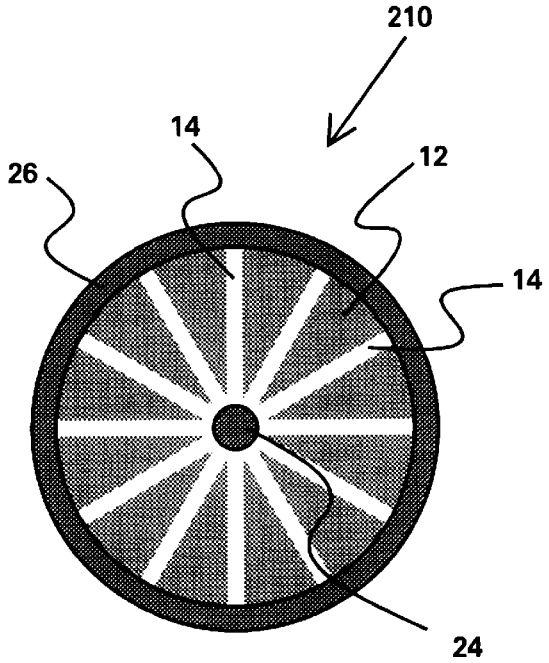
FIG. 5*b* is an end view of the coaxial transmission line and window of FIG. 5*a*.

Additionally, the teachings of the present invention may be used to construct a coaxial window. FIGS. 5*a* and 5*b* depict a coaxial transmission line 210 which contains window 12, both of whose surfaces include a plurality of strips 14 radially extending from the center conductor 24 to the outer conductor 26, much the same as illustrated in FIG. 3.

Figure 6:
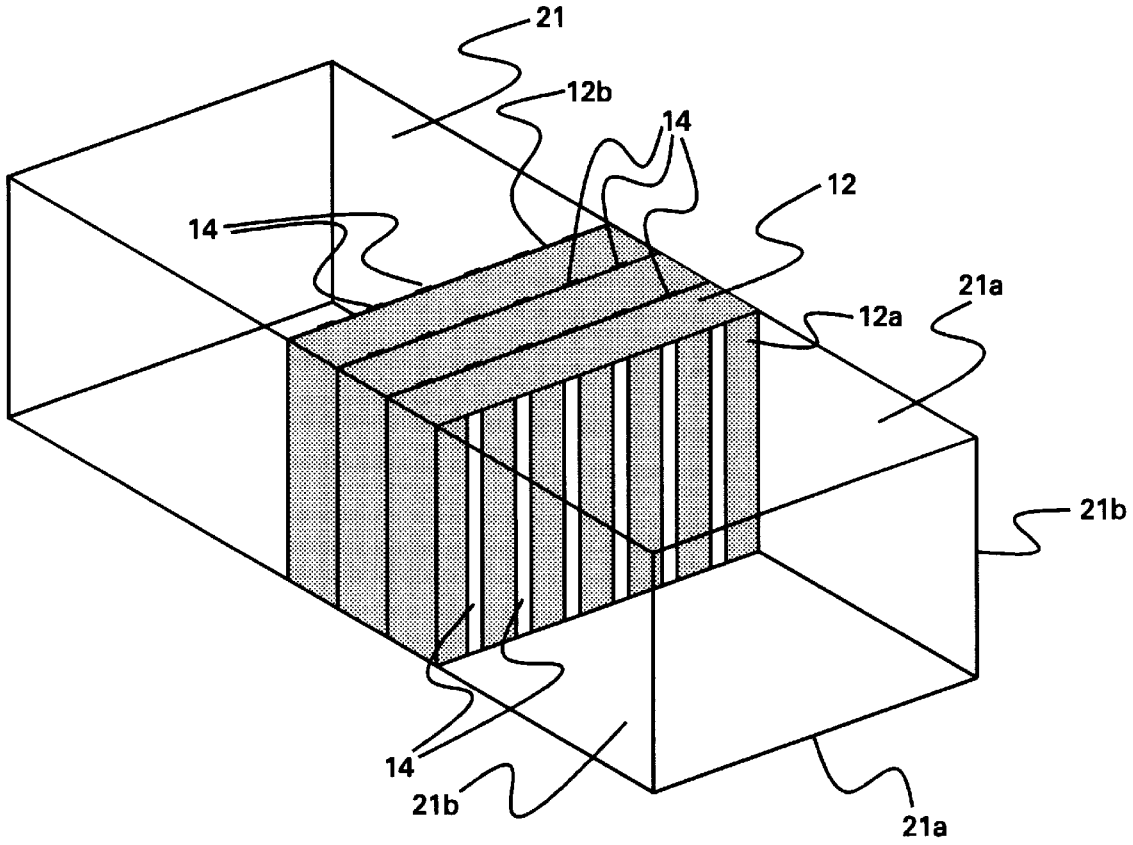
FIG. 6 is a view similar to that of FIG. 2, but depicting a plurality of substrates interleaved with pluralities of high-conductivity strips.

Based on the foregoing description, it will be readily apparent that the teachings of a plurality of narrow strips provided on one or both surfaces of a substrate may be extended to a plurality of substrates 12, interleaved with pluralities of the narrow strips 14. FIG. 6 depicts one such configuration, based on FIG. 2. Further, a circular configuration, based on FIG. 4, in which the high-conductivity layers 114 are replaced by radiating strips, such as shown in FIG. 3, is a logical extension of the teachings herein.

INDUSTRIAL APPLICABILITY

The high average-power microwave window of the present invention, comprising a low-loss ceramic substrate and provided with strips of a high conductivity material on one or both faces is expected to find use in high-average power RF sources such as klystrons and magnetrons.

Thus, there has, been disclosed a high average-power microwave window, comprising a low-loss ceramic substrate and provided with strips of a high conductivity material on one or both faces. It will be appreciated that various changes and modifications of an obvious nature may be made without departing from the spirit of the invention, and all such changes and modifications are considered to fall within the scope of the present invention, as defined by the appended claims.

What is claimed is:

1. A high average-power microwave window comprising at least one substrate having two major opposed surfaces, said substrate comprising a low-loss ceramic material and provided with a plurality of narrow strips of a high thermal conductivity dielectric material on at least one said major surface thereof.

2. The microwave window of claim 1 wherein said substrate is selected from the group consisting of quartz, alumina, sapphire, silicon nitride, and aluminum nitride.

3. The microwave window of claim 1 wherein said plurality of strips is selected from the group consisting of diamond and cubic boron nitride.

4. The microwave window of claim 1 comprising a rectilinear substrate.

5. The microwave window of claim 1 comprising a circular substrate.

6. The microwave window of claim 1 wherein said substrate consists essentially of fused quartz and said plurality of strips consists essentially of polycrystalline diamond.

7. The microwave window of claim 1 comprising one substrate, with both surfaces provided with said plurality of strips.

8. The microwave window of claim 1 comprising a plurality of said substrates, interleaved with pluralities of said narrow strips.

9. A high-average power microwave waveguide comprising at least one wall and including at least one high-average power microwave window, said microwave window comprising at least one substrate having two major opposed surfaces, said substrate comprising a low-loss ceramic material and provided with a plurality of narrow strips of a high thermal conductivity dielectric material on at least one said major surface thereof.

10. The microwave waveguide of claim 9 wherein said substrate is selected from the group consisting of quartz, alumina, sapphire, silicon nitride, and aluminum nitride.

11. The microwave waveguide of claim 9 wherein said plurality of strips is selected from the group consisting of diamond and cubic boron nitride.

12. The microwave waveguide of claim 9 wherein said waveguide comprises four walls defining a rectangular cross-section and wherein said high-power microwave window comprises a rectilinear substrate.

13. The microwave waveguide of claim 9 wherein said waveguide comprises a single wall defining a circular waveguide and said high-power microwave window comprises a circular substrate.

14. The microwave waveguide of claim 9 wherein said substrate consists essentially of fused quartz and said plurality of strips consists essentially of polycrystalline diamond.

15. The microwave waveguide of claim 9 comprising one substrate, with both surfaces provided with said plurality of strips.

16. The microwave waveguide of claim 9 comprising a plurality of said substrates, interleaved with pluralities of said narrow strips.

* * * * *